US005095779A

United States Patent [19]

Batten

[11] Patent Number: 5,095,779

[45] **Date of Patent: * Mar. 17, 1992**

[54] COLLET TYPE FASTENER REMOVAL TOOL

[75] Inventor: Ronald W. Batten, Torrance, Calif.

[73] Assignee: V.S.I. Corporation, Culver City, Calif.

[ * ] Notice: The portion of the term of this patent subsequent to Sep. 5, 2006 has been disclaimed.

[21] Appl. No.: 444,407

[22] Filed: Dec. 1, 1989

[51] Int. Cl.[5] ..... B25B 13/50

[52] U.S. Cl. ..... 81/55; 81/453

[58] Field of Search ..... 81/124.1, 55, 453

[56] References Cited

U.S. PATENT DOCUMENTS

| | | | |
|---|---|---|---|
| 2,370,407 | 2/1945 | McCartney | 81/453 |
| 3,533,314 | 10/1970 | Ostrager | 81/124.1 X |
| 3,550,484 | 12/1970 | Pecoraro | 81/55 X |
| 4,862,773 | 9/1989 | Batten | 81/55 |

FOREIGN PATENT DOCUMENTS

| | | | |
|---|---|---|---|
| 368761 | 4/1963 | Switzerland | 81/453 |
| 904356 | 8/1962 | United Kingdom | 81/453 |

*Primary Examiner*—James G. Smith

*Attorney, Agent, or Firm*—Plante Strauss Vanderburgh and Connors

[57] ABSTRACT

There is disclosed a tool for the removal of locking collars of the frangible fasteners used in the aerospace industry, particularly for removal of fasteners installed in close quarters such in a deep channel where conventional tools cannot grip the collar. The tool has a collet-type chuck to grasp the collar of the fastener and has a lead screw to lock the collet chuck about the collar and permit removal of the collar. For this purpose, the collet chuck has a cylindrical neck which is received within a sleeve. The lead screw is received in the opposite end of the collet sleeve and is threadably engaged in the internally threaded bore of the collet chuck member, preferably with left hand threads, and has a head with wrenching flats. The lead screw has a central axial through bore which receives a key member which is used to immobilize the stud or bolt of the fastener system. A disk member is slidably received within the collet sleeve to eject removed collars from the collet chuck member.

11 Claims, 3 Drawing Sheets

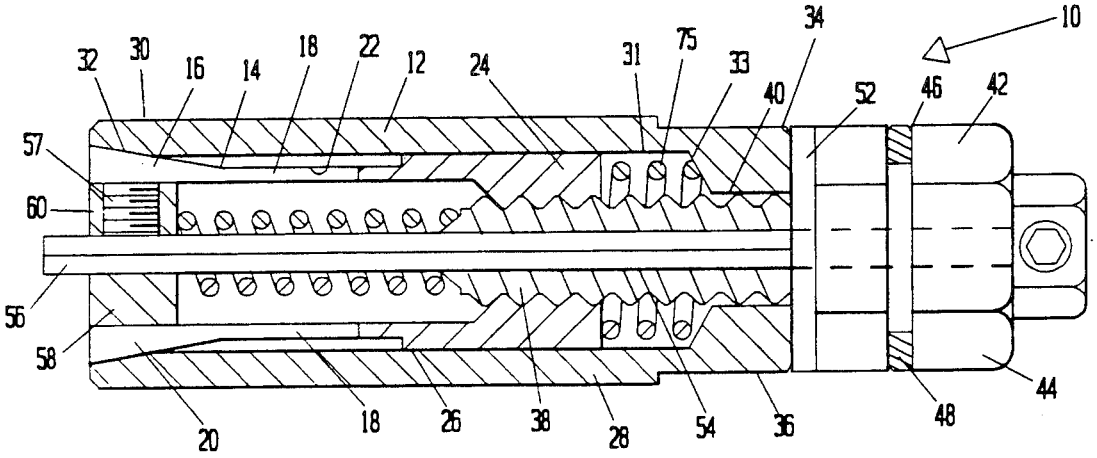
FIGURE 1
FIGURE 2
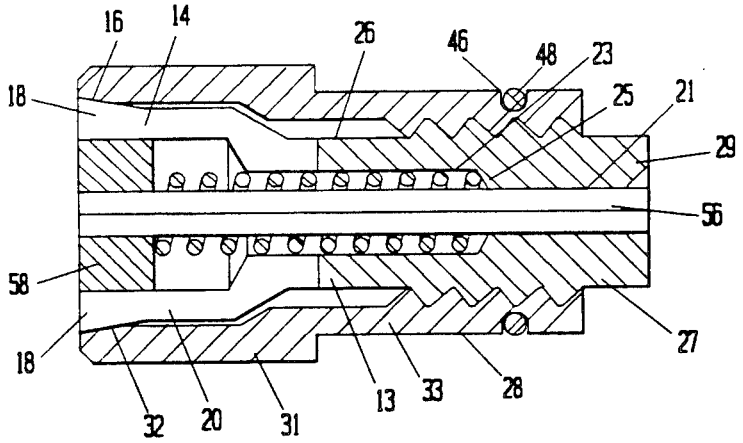

COLLET TYPE FASTENER REMOVAL TOOL

BACKGROUND OF THE INVENTION

1. Field of the Invention

This invention relates to a wrenching tool, and in particular to a tool useful for removal of fasteners which are in recessed locations.

2. Brief Statement of the Prior Art

Frangible fasteners are used extensively in the aerospace industry. These fasteners employ a threaded locking collar which is joined by a notched neck to a wrenching ring which shears from the collar when the applied torque exceeds a predetermined torsional loading. Often the threaded locking collar has an upset portion, usually a slightly elliptical shape to provide a frictional spring lock that prevents the collar from spinning off in the event that the residual tension on the fastener is lost.

These fasteners are applied with wrenching tools which engage the wrenching ring to apply the threaded collar and twist the wrenching ring from the threaded collar when the predetermined torsional loading is exceeded.

It is frequently desirable to loosen or remove threaded locking collars from assembled fasteners. Heretofore, no entirely suitable tool has been devised for this application. The threaded collar commonly has a cylindrical base which tapers into a smaller diameter cylindrical neck. The cylindrical portions of these collars are narrow and are difficult to grasp with conventional tools such as pliers, vise grip clamps, etc. The difficulties with removal are even more acute when the locking collars are recessed. This frequently occurs when the locking collars are seated within the channels and are inaccessible to most tools. Additionally, the use of non-standard tools for loosening or removing of the frangible fasteners is objectionable as such tools can damage the surfaces of the assembled parts.

A fastener collar removal tool is disclosed in U.S. Pat. No. 4,762,030 in which a collet clutch member is threadably received within a collet sleeve. The tool has a central pin which is rotationally immobilized and which has a ball detent that seats in a groove of the collet clutch member to permit the collet to be compressed about the fastener. While, this removal tool is suitable for use with clean, newly applied fasteners, however, it is not suitable for use with stuck or corroded fasteners since the grip of the collet fingers about the collar is limited by the torque which is sufficient to pop the detent ball from its restraining groove in the pin.

In my prior U.S. Pat. No. 4,862,773, I disclose and claim a fastener collar removal tool which also has a collet member. The device of that patent is particularly suitable for use with a power driven ratchet wrench which is reversible to loosen the collet from the fastener collar after its removal. When used with hand ratchet wrenches, it is desirable to provide a mechanism to eject the collar after its removal.

BRIEF DESCRIPTION OF THE INVENTION

The invention is a tool for the removal of locking collars of the frangible fasteners used in the aerospace industry, particularly for use with hand socket wrenches. Unlike the tool described in my prior patent, the tool of this invention has an ejection mechanism to facilitate ejection of the fastener collar after its removal.

The tool of the invention has a collet chuck member with a slotted, tapered base thereby providing collet jaws, and has a cylindrical neck which is received within a sleeve. The collet chuck member has an internally threaded axial bore to receive a lead screw. The lead screw is received in the opposite end of the collet sleeve and is threadably engaged in the internally threaded axial bore of the collet chuck member, preferably with left hand threads. The lead screw has a central axial through bore which receives a key member which is used to immobilize the stud or bolt of the fastener system in loose or non-interference fit applications and a plug is fixed to the end of the key. A compression spring is located between the received end of the lead screw and the plug to eject a collar. Another compression spring is located between the received end of the collet chuck and an internal shoulder of the sleeve to extend the collet chuck member from the sleeve.

BRIEF DESCRIPTION OF THE DRAWINGS

The invention will be described with reference to the FIGURES of which:

FIG. 1 is an elevational sectional view of the tool of the invention;

FIG. 2 is an elevational sectional view of a second embodiment of the tool of the invention;

DESCRIPTION OF PREFERRED EMBODIMENT

Figure 3:
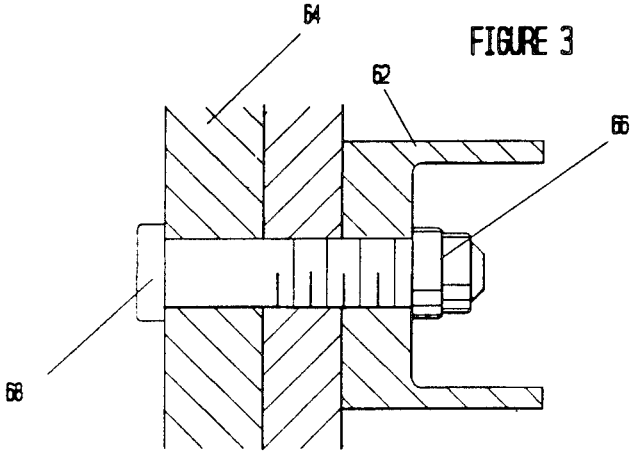
FIG. 3 is an elevational sectional view of a typical aerospace fastener.

Referring now to FIG. 1 the removal tool 10 of the invention has a collet chuck member 12 which has a tapered base 14, with side walls 16 inclined to its longitudinal axis at an angle from 5 to about 25 degrees, preferably from about 10 to 15 degrees. The base 14 has at least one, and preferably three or four, axial slits 18, thereby dividing the base into a plurality of collet jaws 20. The collet chuck member 12 is hollow with a through bore 22 that is internally threaded at its upper end 24. The collet chuck member 12 has a cylindrical shank 26 which is received within a collet sleeve 28.

The collet sleeve 28 is cylindrical and, at its lower end 30 has a tapered counter bore 32 with the same taper as that of the base of the collet chuck member 12. The sleeve also has an enlarged diameter counterbore 31 along most of its length thereby providing an internal annular shoulder 33 adjacent its upper end 34. At its upper end 34, the collet sleeve 28 also has at least one wrenching flat 36 and, preferably, is hexagonally flatted to receive standard wrenches.

A lead screw 38 extends through an axial through bore 40 of the collet sleeve 28. The lead screw 38 has a head 42 with at least one wrenching flat 44, and preferably is of a hexagonally flatted configuration, as shown for attachment of conventional socket wrenches. Preferably, the head 42 has an annular groove 46. A spring clip retainer 48 seats in groove 46. The lead screw 38 is externally threaded, preferably with left hand threads and extends into the internally threaded through bore 22 of the collet chuck member 12. A washer 52 is provided between the upper end 34 of the collet sleeve 28 and the underside of the head 42 of the lead screw 38.

The lead screw 38 has a central, axial through bore 54 which is of sufficient diameter to receive a key member 56. The key member 56 is hexagonal in cross section and is a conventional key member that is used with the frangible fasteners to immobilize bolts in non-interference fit applications.

An ejection plug 58 is slidably received within the collet sleeve 28 and has a central through bore 60 to receive the key member 56. The plug 58 is fixedly secured to the key with a set screw 57. As described hereinafter, the plug 58 ejects a collar after its removal, thereby clearing the tool for reuse.

An ejection spring 74 is captured between the plug 58 and the received end of the lead screw 40, thereby biasing the plug to eject a fastener collar. Another compression spring 75 is captured between the received end of the collet clutch 12 and the internal annular shoulder 33 of the collet sleeve 28. Spring 75 resiliently biases the collet clutch 12 into extension from the collet sleeve 28.

Referring now to FIG. 2, there is illustrated a second embodiment of the invention which is particularly useful in close quarters, where vertical clearance above the fastener is limited. This tool has a collet clutch 13 which has a tapered base 14, with side walls 16 inclined to its longitudinal axis at an angle from 5 to about 25 degrees, preferably from about 10 to 15 degrees. The base 14 has at least one, and preferably three or four, axial slits 18, thereby dividing the base into a plurality of collet jaws 20. The collet chuck member 12 is hollow with a through bore 21 and an enlarged diameter counterbore 23 to provide an internal annular shoulder 25. The collet chuck member 12 has a cylindrical shank 26 which has external threads and which is received within a collet sleeve 28. The upper end 29 of the shank has wrenching flats 27.

The collet sleeve 28 has a cylindrical base 31 and a body 33 with hexagonal flats to be received within a conventional socket. Preferably, the body 33 has an annular groove 46. A spring clip retainer 48 seats in groove 46. At its lower end, the sleeve 28 has a tapered counter bore 32 with the same taper as that of the base of the collet chuck member 12.

A key member 56, which is hexagonal in cross section, is received in the through bore of the chuck member 13. The key extends through plug 58, which is fixedly secured to the end of the key. An ejection spring 74 is captured between the plug 58 and the received end of the lead screw 40, thereby biasing the plug to eject a fastener collar. Referring now to FIG. 3, there is illustrated a typical installation found in the aerospace industry. A channel 62 is bolted to a supporting structure 64 with frangible fastener collar 66 and bolts 68. The locking collar 66 secures the assembly and infrequently require removal. Most conventional tools cannot be used for this removal as the collars 66 are cylindrical and are recessed within the channel 62 rendering the collars inaccessible to conventional gripping tools.

Figure 4:
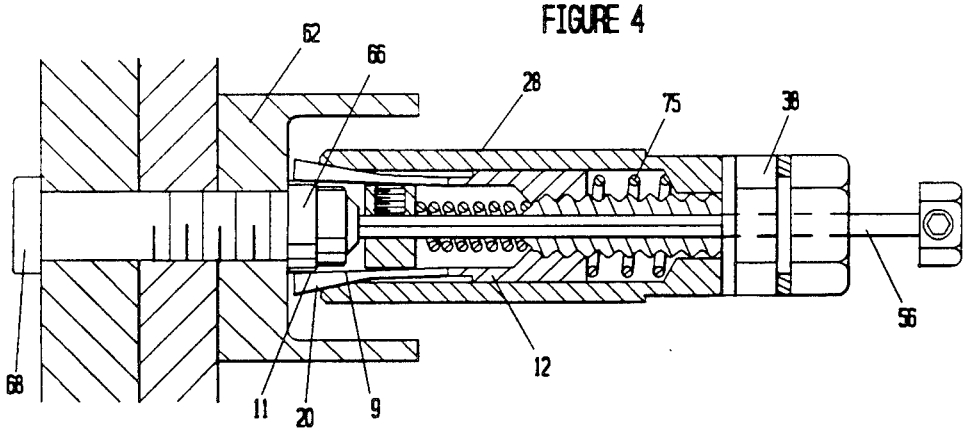
FIG. 4 is an elevational sectional view of the removal tool of FIG. 1 as it is initially positioned to remove the collar of FIG. 3.

Referring now to FIG. 4, the removal tool 10 of the invention is shown as it is initially applied to the locking collar 66 shown in FIG. 3. As illustrated, the collet chuck member 12 has been extended from the collet sleeve 28 to permit the collet jaws 20 to spread sufficiently to be applied over the collar 66. This is achieved by retracting the lead screw 38 from the collet chuck to permit the compression spring 75 to extend the collet chuck 12 from the collet sleeve 28. In most applications, the jaws will engage the fastener in a slight frictional fit. The jaws preferably have gripping surfaces 9 which are outwardly beveled at an angle from 5 to about 10 degrees. It has been found that this causes the jaws to retract very slightly (about 0.005 inch) from the surface of the work piece when the collet clutch is tightened about the fastener. This insures that the face of the work piece will not be damaged by the removal of the fastener. Preferably, the gripping surfaces of the jaws are also serrated with grooves 11 at a depth of about 0.01 inch. The tool is in position for tightening of the collet jaws about the collar 66.

In non-interference fit applications, it is necessary to immobilize the bolt 68 of the fastener during removal of the fastening collar. This is accomplished with the hexagonally flatted key member 56 which extends axially through the entire assembly and engages an internally broached hexagonal recess in the end of the fastener bolt 68. At its opposite end, the key is secured with a conventional tool.

Figure 5:
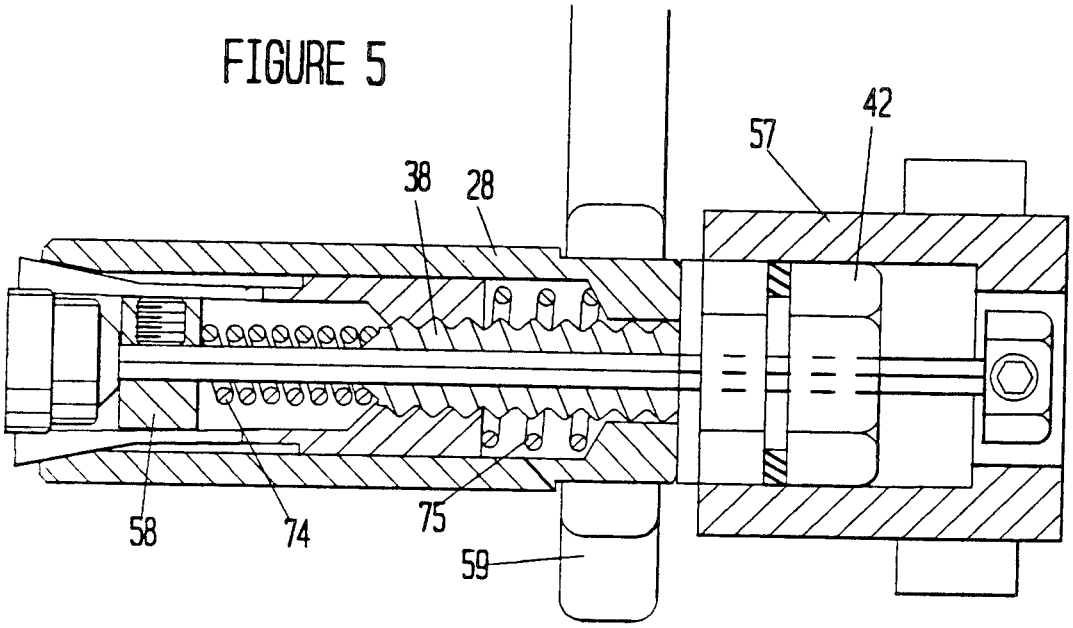
FIG. 5 is an elevational sectional view of the removal tool of FIG. 1 as is tightened about the fastener shown in FIG. 4.

Referring now to FIG. 5, a socket 57 of a wrench has been applied over the head 42 of lead screw 38, and another wrench 59 has been placed over the flatted upper end of the collet sleeve 28 to immobilize the sleeve. As the socket wrench is turned in a counterclockwise motion, as viewed by the user, while holding wrench 57 stationary, the lead screw 38 is advanced into the threaded upper end of the collet chuck 12, retracting the collet chuck 12 into the sleeve 28. As the collet member is retracted in the assembly, collet jaws 20 of the chuck 12 close about the fastener collar 66. As illustrated, the jaws 20 can cut into the fastener 66 a slight degree, depending on the torque applied with the socket wrench.

Once the fastener collar 66 is secured in the collet chuck member 12, the wrench 59 is removed, releasing collet sleeve 28, and the continued application of torque to the lead screw 38 rotates the entire assembly, including the secured fastener collar 66. For this purpose, it is preferred that the threads on the lead screw 38 and the coacting threads on the internal axial bore of the collet chuck member 12 are left handed, thereby avoiding the reversal of the application of torque to remove the fastener collar 66.

After the fastener collar 66 has been removed, it can be released from the collet chuck member 12 by reversing the torque applied to the lead screw 38, while restraining rotation of the collet sleeve with wrench 59, thereby retracting the lead screw 38 from its threaded engagement with the collet chuck member 12. The compression spring 75 will cause the chuck member 12 to extend from the sleeve 28, permitting the jaws 20 of the collet chuck member 12 to open.

As the fastener collar 66 is quite thin, it can wedge or jam in the collet chuck member 12. The ejection plug 58 is biased outwardly to eject the collar 66 by compression spring 74.

Figure 6:
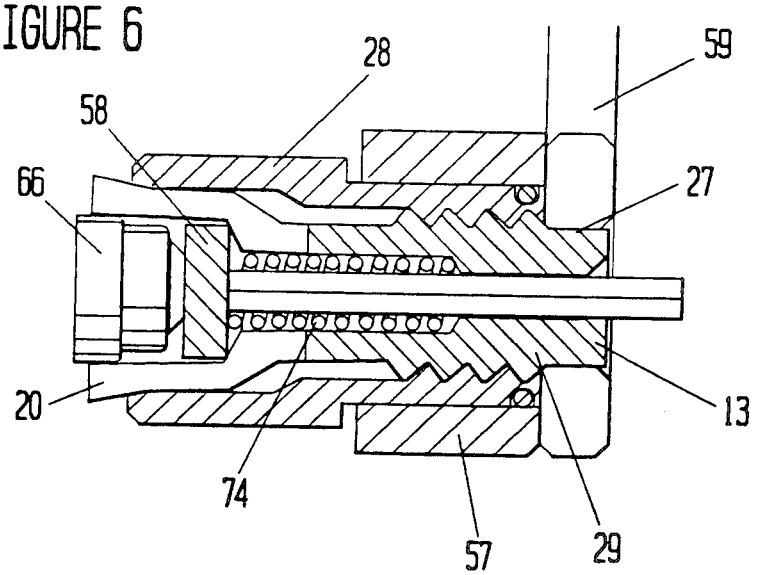
FIG. 6 is an elevational sectional view of the removal tool of FIG. 2 positioned to remove the collar of FIG. 3.

Referring now to FIG. 6, the removal of a fastener collar 66 with the tool shown in FIG. 2 is essentially the same as that previously described. A socket wrench 57 is applied over the hexagonally flatted body of the collet sleeve 28, and the collet chuck is immobilized with a wrench 59 which is placed over the flatted end 29 of the shank of the collet sleeve 13. This permits drawing of the collet chuck 13 into the sleeve 28, gripping the fastener collar 66. The wrench 59 is then removed and the collar is loosened and removed with the socket wrench. The wrench 59 is then replaced and the rotation is reversed to extend the collet chuck 13 from the sleeve. Compression spring 74 ejects the collar 66 from the jaws 20 of the collet chuck 13.

As previously mentioned, the inside surfaces of the jaws of the collet clutch are preferably provided with serrations which are about 0.01 inch in depth. These serrations permit gripping of fasteners such as Eddie Bolt fasteners, which have a narrow cylindrical base and a lobed collar.

The removal tool is specifically intended for use in close quarters such as encountered when the collar of the fastener is received within a deep channel, inaccessible to conventional tools.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A fastener collar removal tool comprising:

a. a cylindrical collet chuck member having an outwardly flared base with segmented jaws and an upper cylindrical neck having an internally threaded bore;

b. a collet sleeve having at least one external flat and a through bore having an enlarged diameter counterbore to provide an internal shoulder at one end, an outwardly flared opposite end and receiving the flared base and cylindrical neck of said collet chuck member;

c. a lead screw having a head with at least one wrenching flat and a threaded shank with an axial through bore slidably received in said axial through bore of said collet sleeve and threadably engaged in said internally threaded bore of said collet chuck member;

d. an elongated key having at least one continuous flat slidably received in said axial through bore of said lead screw; and a. a first compression coil spring within said collet sleeve and captured between the received end of said collet chuck member and the internal shoulder of said collet sleeve to bias said collet chuck outwardly of said collet sleeve.

2. The improvement in a fastener collar removal tool according to claim 1 which also includes a spring retainer fixedly secured to the received end of said key and a second compression coil spring captured between said spring retainer and the received end of said lead screw to bias said spring retainer and key towards said collet jaws.

3. The tool of claim 1 wherein said internal threads on said collet chuck member and said external threads of the shank of said lead screw are left hand threads.

4. The tool of claim 1 including at least one wrenching flat on the upper external wall of said collet sleeve.

5. The tool of claim 1 wherein the head of said lead screw has an annular groove with a circular spring received in said annular groove.

6. The tool of claim 1 including a washer between the head of said lead screw and the upper end of said collet sleeve.

7. A collar fastener removal tool which comprises:

a. a cylindrical collet chuck member having an outwardly flared base with segmented jaws and an upper, externally threaded neck, and a through bore with a larger diameter counterbore to provide an internal annular shoulder therein;

b. a collet sleeve having at least one external flat and an internally threaded through bore with an outwardly flared lower end receiving the flared base and threaded cylindrical neck of said collet chuck member;

c. an elongated key having at least one continuous flat slidably received in said axial through bore of said collet chuck member; and d. a spring retainer fixedly secured to the received end of said key and a compression coil spring captured between said spring retainer and said internal shoulder to bias said spring retainer and key towards said collet jaws, thereby serving to eject a collar from said jaws.

8. The collar fastener removal tool of claim 7 wherein said collet sleeve has a flatted shank to fit a socket wrench.

9. The collar fastener removal tool of claim 7 wherein said external threads on said collet chuck member and said internal threads of the collet sleeve are left hand threads.

10. The tool of claim 7 wherein the upper end of said collet chuck member extends beyond said collet sleeve and bears at least one wrenching flat.

11. The tool of claim 7 wherein the upper end of said collet sleeve has an annular groove with a circular spring received in said annular groove.

* * * * *